US012622560B2

(12) United States Patent
Han

(10) Patent No.: US 12,622,560 B2
(45) Date of Patent: May 12, 2026

(54) BREAKPOINT CONTINUOUS MOPPING METHOD AND APPARATUS FOR MOPPING ROBOT, MEDIUM AND ELECTRONIC DEVICE

(71) Applicant: Beijing Roborock Technology Co., Ltd., Beijing (CN)

(72) Inventor: Xinyu Han, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 279 days.

(21) Appl. No.: 18/257,628

(22) PCT Filed: Jun. 29, 2021

(86) PCT No.: PCT/CN2021/103270
§ 371 (c)(1),
(2) Date: Jun. 15, 2023

(87) PCT Pub. No.: WO2022/142211
PCT Pub. Date: Jul. 7, 2022

(65) Prior Publication Data

US 2024/0108189 A1 Apr. 4, 2024

(30) Foreign Application Priority Data

Dec. 31, 2020 (CN) ..... 202011638584.7

(51) Int. Cl.
*A47L 11/40* (2006.01)
*A47L 11/24* (2006.01)
*A47L 11/28* (2006.01)

(52) U.S. Cl.
CPC ..... *A47L 11/4011* (2013.01); *A47L 11/24* (2013.01); *A47L 11/28* (2013.01); *A47L 11/4002* (2013.01); *A47L 11/4083* (2013.01); *A47L 2201/00* (2013.01)

(58) Field of Classification Search
None
See application file for complete search history.

(56) References Cited

U.S. PATENT DOCUMENTS

| | | | | |
|---|---|---|---|---|
| 2020/0069140 | A1 | 3/2020 | Orzechowski et al. | |
| 2020/0121153 | A1* | 4/2020 | Letsky | A47L 9/2873 |
| 2020/0297179 | A1 | 9/2020 | Fang | |
| 2020/0383547 | A1* | 12/2020 | Sutter | A47L 11/4013 |

FOREIGN PATENT DOCUMENTS

| | | | | |
|---|---|---|---|---|
| CN | 105212840 | A | | 1/2016 |
| CN | 106627128 | A | | 5/2017 |
| CN | 108541308 | A | | 9/2018 |
| CN | 109528094 | A | | 3/2019 |
| CN | 109602340 | A | | 4/2019 |
| CN | 109602356 | A | | 4/2019 |
| CN | 209346901 | U | | 9/2019 |
| CN | 111166238 | A | * | 5/2020 |
| CN | 111345734 | A | | 6/2020 |
| CN | 111345741 | A | | 6/2020 |
| CN | 111734650 | A | | 10/2020 |
| CN | 211723028 | U | | 10/2020 |
| CN | 112754360 | A | | 5/2021 |
| WO | 2020143291 | A1 | | 7/2020 |

OTHER PUBLICATIONS

Machine translation: Zhang et al.; CN111166238 (Year: 2020).*
International Search Report for International Application No. PCT/CN2021/103270 mailed Sep. 28, 2021.
First Office Action for CN Patent Application No. 202011638584.7 mailed Sep. 15, 2021.
Second Office Action for CN Patent Application No. 202011638584.7 mailed May 16, 2022.
Notice of Allowance for CN Patent Application No. 202011638584.7 mailed Nov. 16, 2022.

* cited by examiner

*Primary Examiner* — Natasha N Campbell
(74) *Attorney, Agent, or Firm* — Perilla Knox & Hildebrandt LLP; Kenneth A. Knox

(57) ABSTRACT

A breakpoint continuous mopping method and apparatus for a mopping robot, a medium, and an electronic device, are described. In the present disclosure, if the mopping robot working in a hybrid mode detects that a water tank for supplying water for mopping is short of water at a first breakpoint position, the mopping robot is switched to a mopping mode after the water tank is supplemented with water, and carries out supplementary mopping on an unmopped region including the first breakpoint position. Thus, it is guaranteed that the mopping robot can complete sweeping and mopping tasks.

6 Claims, 2 Drawing Sheets

BREAKPOINT CONTINUOUS MOPPING METHOD AND APPARATUS FOR MOPPING ROBOT, MEDIUM AND ELECTRONIC DEVICE

CROSS-REFERENCE TO RELATED APPLICATIONS

This application is a national phase application under 35 U.S.C. § 371 of International Patent Application No. PCT/CN2021/103270, filed on Jun. 29, 2021, which is based upon, and claims the benefit of and priority to Chinese Patent Application No. 202011638584.7, filed on Dec. 31, 2020, the contents of which being incorporated by reference in their entireties herein.

TECHNICAL FIELD

The present disclosure relates to the field of computer technologies and, more particularly, to a breakpoint continuous mopping method and apparatus for a mopping robot, a medium, and an electronic device.

BACKGROUND

With the progress of science and technology and social development, particularly under the influence of the accelerating rhythm of life and increasing work pressure, people expect to be free from tedious daily household cleaning. A mopping robot emerges as a new generation intelligent household device that can sweep while mopping.

However, in a case of water shortage, generally, a water pump stops working and the mopping robot is switched into a pure cleaning mode to continue to work until the sweeping work is completed. With respect to the mopping work after water shortage, supplementary mopping is omitted. In addition, in this case, a mopping forbidden region may be neglected in a sweeping mode, resulting in sweeping omission.

SUMMARY

The Summary section is provided to introduce the conceptions of the present disclosure in a simplified form, and those conceptions are described in detail in the Detailed Description section. The summary section is not intended to identify the key features or essential features of the claimed technical solutions, nor is it intended to limit the scope of the claimed technical solutions.

The present disclosure aims to provide a breakpoint continuous mopping method and apparatus for a mopping robot, a medium, and an electronic device, so at to at least solve one of the above-mentioned technical problems. The specific solutions are as follows.

According to a first aspect of the present disclosure, a breakpoint continuous mopping method for a mopping robot is provided and includes:

marking, in response to detecting that a water tank for supplying water for mopping is short of water at a first position, the first position as a first breakpoint position in a hybrid mode, wherein the hybrid mode at least includes a mopping mode; and in response to detecting that the water tank is supplemented with water, carrying out supplementary mopping on an unmopped region including the first breakpoint position in the mopping mode.

According to a second aspect of the present disclosure, an electronic device is provided and includes:

one or more processors; and a storage apparatus used for storing one or more programs, wherein the one or more programs, when executed by the one or more processors, the one or more processors are configured to:

mark, in response to detecting that a water tank for supplying water for mopping is short of water at a first position, the first position as a first breakpoint position in a hybrid mode, wherein the hybrid mode at least includes a mopping mode; and in response to detecting that the water tank is supplemented with water, carry out supplementary mopping on an unmopped region including the first breakpoint position in the mopping mode.

According to a third aspect of the present disclosure, a non-transitory computer-readable storage medium is provided with a computer program stored therein, wherein the computer program, when executed by a processor, the processor is configured to:

mark, in response to detecting that a water tank for supplying water for mopping is short of water at a first position, the first position as a first breakpoint position in a hybrid mode, wherein the hybrid mode at least includes a mopping mode; and in response to detecting that the water tank is supplemented with water, carry out supplementary mopping on an unmopped region including the first breakpoint position in the mopping mode.

BRIEF DESCRIPTION OF THE DRAWINGS

In combination with the drawings and the specific embodiments below, the above-mentioned and other features, advantages, and aspects of each embodiment of the present disclosure become more apparent. Throughout the accompanying drawings, the same or similar reference signs represent the same or similar elements. It should be understood that the drawings are schematic, and components and elements are not necessarily drawn in proportion. In the figures.

DETAILED DESCRIPTION

Figure 1:
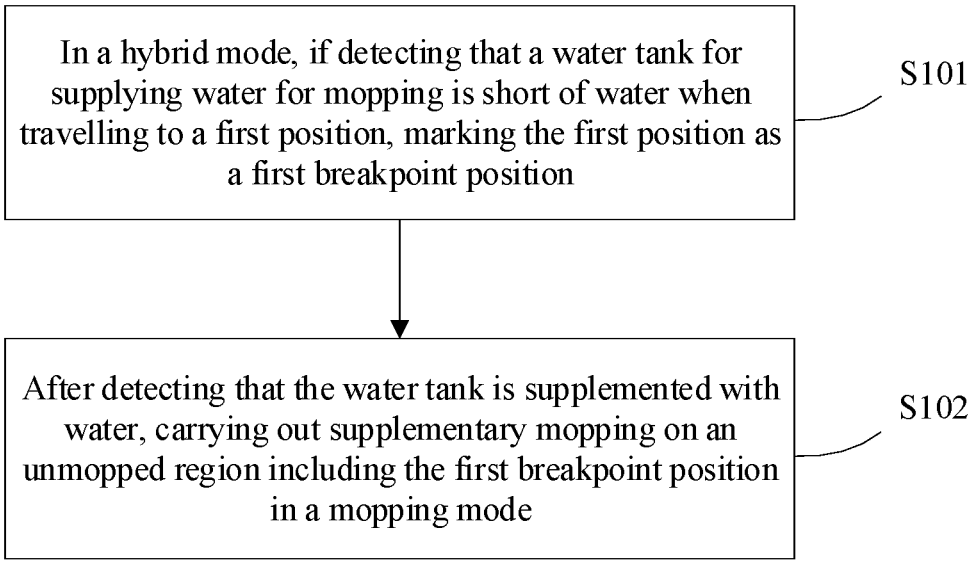
FIG. 1 shows a flow chart of a breakpoint continuous mopping method for a mopping robot according to an embodiment of the present disclosure.

The embodiments of the present disclosure will be described in further detail with reference to the drawings. Some embodiments of the present disclosure are shown in the drawings, but it should be understood that the present disclosure may be implemented in various forms and should not be interpreted as a limitation to the embodiments described herein. On the contrary, these embodiments are provided for understanding the present disclosure more thoroughly and completely. It should be understood that the drawings and the embodiments of the present disclosure are merely used for exemplary illustration, and are not used for limiting the scope of protection of the present disclosure.

It should be understood that each step described in the method embodiments of the present disclosure may be executed in different sequences and/or executed in parallel. In addition, the method embodiments may include additional steps and/or omit execution of the shown or described steps. The scope of the present disclosure is not limited in this aspect.

The terms "include/comprise" and deformation thereof used herein are open including, i.e., "include, but not limited to". The term "based on" refers to "at least partially based on". The term "one embodiment" represents "at least one embodiment". The term "another embodiment" represents "at least one additional embodiment". The term "some embodiments" represents "at least some embodiments". Related definitions of other terms will be called out in the description below.

It should be noted that the terms, such as "first" and "second", mentioned in the present disclosure are merely used for distinguishing different apparatuses, modules, or units, and are not used for limiting the sequence of functions executed by these apparatuses, modules, or units, or a mutual dependence relationship therebetween.

It should be noted that the terms such as "one" and "a plurality of" mentioned in the present disclosure are schematic, not restrictive, and those skilled in the art should understand that unless otherwise specified in the context, it should be understood as "one or more".

The names of messages or information interacted among a plurality of apparatuses in the embodiments of the present disclosure are merely used for illustration, and are not used for limiting the scope of these messages or information.

Optional embodiments of the present disclosure will be illustrated in detail below in combination of the drawings.

Throughout the specification, some terms that may be involved in the present disclosure are explained below:

1. Supplementary mopping: refers to that the mopping robot continues the previously unfinished mopping work after its mopping process has been interrupted;
2. Unmopped region: refers to a region that has not yet been mopped;
3. Unswept region: refers to a region that has not yet been swept;
4. Mopping forbidden region, refers to a region where mopping is not allowed.

A breakpoint continuous mopping method for a mopping robot is provided according to an embodiment, i.e., a first embodiment, of the present disclosure.

The embodiment of the present disclosure will be illustrated in detail below in combination with FIG. 1.

In S101, in a hybrid mode, if a mopping robot detects that a water tank for supplying water for mopping is short of water when traveling to a first position, the first position is marked as a first breakpoint position.

Working or operation of the mopping robot in the hybrid mode includes a sweeping mode and a mopping mode. In the hybrid mode, the mopping robot mops while sweeping.

The water tank is used for supplying water for mopping. However, due to the limited volume of the water tank, it is likely that, when the mopping robot does not complete mopping, the water tank is short of water.

In order to effectively manage the working or operation of the mopping robot, generally, a water level detection apparatus is mounted in the water tank or in a water pipe for detecting the water level condition in the water tank in real time. Water shortage of the water tank is that the water level detection apparatus detects that the water level in the water tank is too low to supply water for mopping.

Under normal conditions, after detecting that the water tank is short of water, the method further includes:

S101-1: sweeping an unswept region from the first breakpoint position in the sweeping mode.

In different working modes or modes of operation, the mopping robot has different working regions. In the sweeping mode, the mopping robot works according to a preset sweeping region. In the mopping mode, the mopping robot works according to a preset mopping region. In the hybrid mode, the mopping robot works according to the preset mopping region.

With respect to the related art, after the mopping robot detects water shortage in the hybrid mode and is switched to the sweeping mode, the mopping robot still continues to complete sweeping according to the preset mopping region. Not only is an unmopped region omitted with supplementary mopping, but also a mopping forbidden region belonging to the sweeping region is neglected, resulting in sweeping omission. According to the embodiment of the present disclosure, in this case, after being switched to the sweeping mode from the hybrid mode, the mopping robot continues to sweep according to the preset sweeping region. Here, in the sweeping mode, the sweeping region includes the mopping region and the mopping forbidden region in the mopping mode. Therefore, the unswept region includes the unmopped region and the mopping forbidden region. It is thus ensured that, in the sweeping mode, a region which can be swept cannot be omitted.

In S102, when it is detected that the water tank is supplemented with water, supplementary mopping is carried out on the unmopped region including the first breakpoint position in the mopping mode.

Specifically, the water being supplemented with water refers to that the water is supplemented with water to a predetermined water level.

According to the embodiment of the present disclosure, after water supplementation, by carrying out supplementary mopping on the unmopped region, it is ensured that the mopping robot can complete the sweeping and mopping tasks.

Specifically, the embodiment of the present disclosure provides two specific scenes in which supplementary mopping is carried out on the unmopped region.

Scene I

After detecting that the water tank is supplemented with the water, carrying out supplementary mopping on the unmopped region, including the first breakpoint position, in the mopping mode specifically includes:

S102*a*: if a sweep of the unswept region is completed in the sweeping mode and after detecting that the water tank is supplemented with water, carrying out supplementary mopping on the unmopped region from the first breakpoint position in the mopping mode.

In the sweeping mode, after completing sweeping the unswept region from the first breakpoint, the mopping robot carries out water supplementation on the water tank. After water supplementation, the mopping robot returns to the first breakpoint position and starts to carry out supplementary mopping on the unmopped region.

Scene II

When detecting that the water tank is supplemented with the water, carrying out supplementary mopping on the unmopped region including the first breakpoint position in the mopping mode specifically includes:

S102*b*: if sweeping to a second position in the sweeping mode and after detecting that the water tank is supplemented with the water at the second position, carrying out supplementary mopping on the unmopped region from the second position in the mopping mode.

In the sweeping mode, when the mopping robot sweeps to the second position from the first breakpoint, temporary water supplementation is carried out on the water tank at the second position. For example, the operation of the mopping robot is manually interrupted and temporary water supplementation is carried out. After detecting temporary water supplementation, the mopping robot is automatically switched to the mopping mode from the sweeping mode and carries out supplementary mopping on the unmopped region from the second position.

In order to avoid a case that a traveling route of the mopping robot is a back route, in an embodiment, carrying out supplementary mopping on the unmopped region from the second position in the mopping mode includes:

S102*b*-1: after carrying out supplementary mopping on an unmopped region which is not swept from the second position in the mopping mode, carrying out supplementary mopping on an unmopped region from the first breakpoint position to the second position.

After temporary water supplementation, the mopping robot is automatically switched to the mopping mode from the sweeping mode and loads a preset mopping route. The mopping robot continues to move forwards to carry out supplementary mopping on the unmopped region which is not swept along the mopping route from the second position where temporary water supplementation is carried out. After carrying out supplementary mopping to reach the end point of the mopping route, the mopping robot returns to the first breakpoint position and carries out supplementary mopping on the unmopped region from the first breakpoint position to the second position, i.e., a region swept in the sweeping mode. In this way, the mopping robot is prevented from going back without omitting the unmopped region, so that the traveling time is reduced and the working efficiency is improved.

If the floor is large enough, the mopping robot needs to be supplemented with water repeatedly to complete the mopping work on the overall floor. In an embodiment, the method further includes the following.

In S105, in the mopping mode, if it is detected that the water tank is short of water when traveling to a third position, the third position is marked as a second breakpoint position and a pre-marked water supplementation position is returned to supplement water.

When the mopping robot completes first water supplementation and is switched to the mopping mode from the hybrid mode or the sweeping mode, if the case of water shortage of the water tank again, the mopping robot directly returns to the pre-marked water supplementation position from a water shortage position (i.e., the second breakpoint position) to supplement water.

In S106, after it is detected that the water tank is supplemented with the water, supplementary mopping is carried out on the unmopped region from the second breakpoint position in the mopping mode.

After the water tank is supplemented with water, the mopping robot returns to the second breakpoint position and continues to carry out supplementary mopping on the unmapped region from the second breakpoint position in the mopping mode. If in the supplementary mopping process, the water tank is short of water again, the operation is repeated, until the mopping task is completed.

The embodiment of the present disclosure provides that, if the mopping robot working in the hybrid mode detects that the water tank for supplying water for mopping is short of water at the first breakpoint position, the mopping robot is switched to the mopping mode after the water tank is supplemented with water, and carries out supplementary mopping on the unmopped region including the first breakpoint position. Thus, it is guaranteed that the mopping robot can complete the sweeping and mopping tasks.

Corresponding to the first embodiment of the present disclosure, a breakpoint continuous mopping apparatus for a mopping robot is further provided according to an embodiment, i.e., a second embodiment, of the present disclosure. The second embodiment is basically similar with the first embodiment, so the description of the second embodiment is relatively simple, and the related part can refer to the corresponding illustration of the first embodiment. The apparatus embodiment described below is merely schematic.

Figure 2:
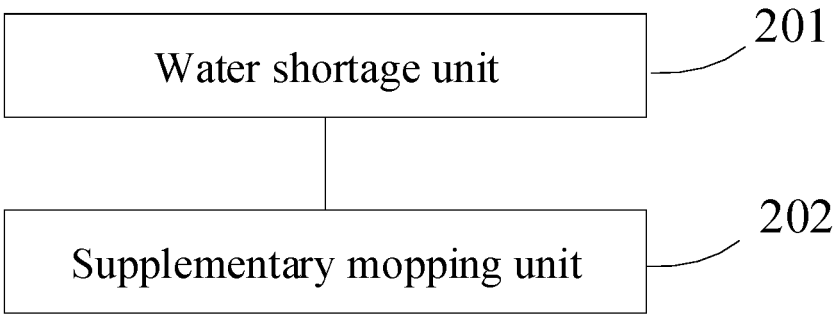
FIG. 2 shows a unit block diagram of a breakpoint continuous mopping apparatus for a mopping robot according to an embodiment of the present disclosure.

FIG. 2 shows an embodiment of a breakpoint continuous mopping apparatus for a mopping robot, as provided by the present disclosure.

As shown in FIG. 2, the present disclosure provides the breakpoint continuous mopping apparatus for the mopping robot, including the following units.

A water shortage unit 201 is used for, in a hybrid mode when detecting that a water tank for supplying water for mopping is short of water when traveling to a first position, marking the first position as a first breakpoint position, the hybrid mode at least including a mopping mode.

A supplementary mopping unit 202 is used for, when detecting that the water tank is supplemented with water, carrying out supplementary mopping on an unmopped region including the first breakpoint position in the mopping mode.

In an embodiment, the hybrid mode further includes a sweeping mode.

Correspondingly, the apparatus further includes:

a sweeping unit used for sweeping an unswept region from the first breakpoint position in the sweeping mode.

In an embodiment, the supplementary mopping unit is specifically used for, if a sweep of the unswept region is completed in the sweeping mode and after detecting that the water tank is supplemented with water, carrying out supplementary mopping on the unmopped region from the first breakpoint position in the mopping mode.

In an embodiment, the supplementary mopping unit is specifically used for, if sweeping to a second position in the sweeping mode and after detecting that the water tank is supplemented with the water at the second position, carrying out supplementary mopping on the unmopped region from the second position in the mopping mode.

In an embodiment, carrying out supplementary mopping on the unmopped region from the second position in the mopping mode includes:

after carrying out supplementary mopping on an unmopped region which is not swept from the second position in the mopping mode, carrying out supplementary mopping on an unmopped region from the first breakpoint position to the second position.

In an embodiment, the supplementary mopping unit is further used for:

in the mopping mode, if detecting that the water tank is short of water when traveling to a third position, marking the third position as a second breakpoint position and returning to a pre-marked water supplementation position to supplement water; and after detecting that the water tank is supplemented with the water, carrying out supplementary mopping on the unmopped region from the second breakpoint position in the mopping mode.

In an embodiment, the unswept region includes the unmopped region and a mopping forbidden region.

According to the embodiment of the present disclosure, if the mopping robot working in the hybrid mode detects that the water tank for supplying water for mopping is short of water at the first breakpoint position, the mopping robot is switched to the mopping mode after the water tank is supplemented with water, and carries out supplementary mopping on the unmopped region including the first breakpoint position. Thus, it is guaranteed that the mopping robot can complete sweeping and mopping tasks.

An electronic device is provided according to a third embodiment of the present disclosure. The electronic device is applicable to a breakpoint continuous mopping method for a mopping robot, and includes at least one processor (i.e., at least one hardware processor) and a memory in communication connection with the at least one processor, wherein the memory stores instructions executable by the at least one processor, and the instructions, when executed by the at least one processor, cause the at least one processor to execute the breakpoint continuous mopping method for the mopping robot according to the first embodiment.

A computer storage medium for a breakpoint continuous mopping method for a mopping robot is provided according to a fourth embodiment of the present disclosure. The computer storage medium stores computer-executable instructions. The computer-executable instructions, when executed by a processor, cause the processor to execute the breakpoint continuous mopping method for the mopping robot according to the first embodiment.

Figure 3:
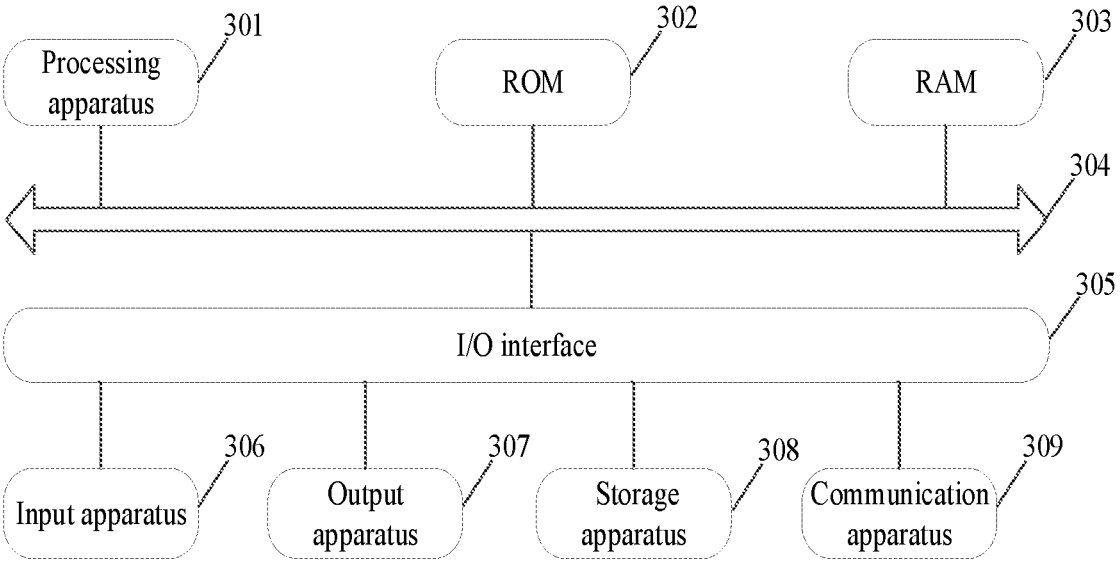
FIG. 3 shows a schematic diagram of a connecting structure of an electronic device according to an embodiment of the present disclosure.

Referring to FIG. 3, a structural schematic diagram is shown applicable to implement an electronic device according to an embodiment of the present disclosure. A terminal device in the embodiment of the present disclosure may include, but is not limited to, mobile terminals such as a mobile phone, a notebook computer, a digital broadcasting receiver, a personal digital assistant (PAD), a PAD (tablet personal computer), a portable multimedia player (PMP) and a vehicle-mounted terminal (e.g., a vehicle-mounted navigation terminal), and fixed terminals, such as a digital TV and a desktop computer. The electronic device shown in FIG. 3 is merely an example, and should not limit the functions and the use scope of the embodiments of the present disclosure.

As shown in FIG. 3, the electronic device may include a processing apparatus 301 (e.g., a central processing unit, a graphics processing unit, or the like) which can execute various proper actions and processing according to programs stored in a read-only memory (ROM) or programs loaded into a random-access memory (RAM) 303 from a storage apparatus 308. In the RAM 303, various programs and data required for operation of the electronic device are also stored. The processing apparatus 301, the ROM 302, and the RAM 303 are connected with each other by a bus 304. An input/output (I/O) interface 305 is also connected to the bus 304.

Generally, the following apparatuses may be connected to the I/O interface 305: an input apparatus 306 including, for example, a touch screen, a touchpad, a keyboard, a mouse, a camera, a microphone, an accelerometer, a gyroscope, and the like: an output apparatus 307 including, for example, a liquid crystal display (LCD), a speaker, a vibrator, and the like: a storage apparatus 308 including, for example, a magnetic tape, a hard disk, and the like: and a communication apparatus 309. The communication apparatus 309 can allow the electronic device to carry out wired or wireless communication with other devices so as to exchange data. FIG. 3 shows the electronic device with various apparatuses, but it should be understood that all shown apparatuses are not required to be implemented or owned. More or fewer apparatuses may be alternatively implemented or owned.

Particularly, according to the embodiments of the present disclosure, the process described above with reference to the flow chart may be implemented as a computer software program. For example, a computer program product is provided according to an embodiment of the present disclosure, includes a computer program carried on a non-transitory computer-readable medium, where the computer program contains a program code for executing the method shown in the flow chart. In such an embodiment, the computer program may be downloaded and installed from the network by the communication apparatus 309, or installed from the storage apparatus 308, or installed from the ROM 302. When the computer program is executed by the processing apparatus 301, the above functions defined in the method provided by the embodiment of the present disclosure are executed.

It should be noted that the above storage medium in the present disclosure may be a computer-readable signal medium or a computer-readable storage medium, or any combination of the two. The computer-readable storage medium may be, for example, but not limited to, an electrical, magnetic, optical, electromagnetic, infrared, or semiconductor system, apparatus, or device, or a combination of any of the above. More specific examples of the computer-readable storage medium may include, but not limited to: an electrical connection with one or more wires, a portable computer disk, a hard disk, a random-access memory (RAM), a read-only memory (ROM), an erasable programmable read-only memory (EPROM or flash memory), optical fiber, a portable compact disk read-only memory (CD-ROM), an optical storage device, a magnetic storage device, or any suitable combination of the above. In the present disclosure, the computer-readable storage medium may be any tangible medium which contains or stores a program, and the program may be used by or in combination with an instruction execution system, apparatus, or device. In the present disclosure, the computer-readable signal medium may include a data signal propagated in a baseband or as part of a carrier wave, and a computer-readable program code is carried therein. This propagated data signal may be in many forms, including but not limited to an electromagnetic signal, an optical signal, or any suitable combination of the above. The computer-readable signal medium may also be any storage medium other than the computer-readable storage medium, and the computer-readable signal medium may send, propagate, or transmit the program for use by or in combination with the instruction execution system, apparatus, or device. The program code contained on the storage medium may be transmitted by any suitable medium, including, but not limited to: a wire, an optical cable, RF (radio frequency), etc., or any suitable combination of the above.

In some embodiments, the client and the server can communicate by using any currently known or future developed network protocol, for example, an HTTP (HyperText Transfer Protocol), and can be interconnected by a communication network of any form or any medium. Examples of the communication network include a local area network (LAN), a wide area network (WAN), an internet network (for example, the Internet), and an end-to-end network (for example, an ad hoc end-to-end network), and any currently known or future developed network.

The above computer-readable storage medium may be included in the above electronic device, or may exist alone without being assembled into the electronic device.

The computer program codes for executing the operations of the present disclosure may be written in one or more programming languages or a combination thereof. The above programming languages include, but not limited to, object-oriented programming languages, such as Java, Smalltalk and C++, and also include conventional procedural programming languages, for example, "C" language or similar programming languages. The program codes may be executed entirely on a user computer, partly on the user computer, as an independent software package, partly on the user computer and partly on a remote computer, or entirely on the remote computer or a server. In the case of the remote computer, the remote computer may be connected to the user computer through any type of network, including the LAN or WAN, or may be connected to an external computer (for example, the Internet connection by an Internet service provider).

The flowcharts and block diagrams in the accompanying drawings of the present disclosure show the possible architecture, functions, and operations of a system, the method, and a computer program product according to various embodiments of the present disclosure. In this regard, each block in the flowcharts or block diagrams can represent a module, a program segment or a part of codes, and the module, the program segment or the part of the codes contains one or more executable instructions for implementing the defined logical functions. It should also be noted that in some implementations as alternatives, the functions labeled in the blocks can occur in an order different from the order labeled in the accompanying drawings. For example, two sequentially shown blocks can be substantially executed in parallel in fact, and they sometimes can also be executed in a reverse order, depending on related functions. It should also be noted that each block in the block diagrams and/or the flowcharts and the combination of the blocks in the block diagrams and/or the flowcharts can be implemented by a dedicated system based on hardware for executing defined functions or operations, or can be implemented by a combination of the dedicated hardware and computer instructions.

The units described in the embodiments of the present disclosure may be implemented in a software fashion or may be implemented in a hardware fashion. The names of the units do not constitute a limitation to the units in some cases.

The functions described above herein may be performed, at least in part, by one or more hardware logic components. For example, non-restrictively, exemplary types of hardware logic components that can be used include: a field programmable gate array (FPGA), an application-specific integrated circuit (ASIC), an application-specific standard product (ASSP), a system on chip (SOC), a complex programmable logic device (CPLD), and the like.

In the context of the present disclosure, a machine-readable medium may be a tangible medium that may contain or store a program for use by or in conjunction with an instruction execution system, apparatus or device. The machine-readable medium may be a machine-readable signal medium or a machine-readable storage medium. The machine-readable medium may include, but not limited to, an electronic, magnetic, optical, electromagnetic, infrared or semiconductor system, apparatus or device, or any suitable combination of the foregoing. A more specific example of the machine-readable storage medium includes an electrical connection based on one or more wires, a portable computer disk, a hard disk, a random-access memory (RAM), a read-only memory (ROM), an erasable programmable read-only memory (an EPROM or a flash memory), an optical fiber, a portable compact disk read-only memory (CD-ROM), an optical storage device, a magnetic storage device, or any suitable combination of the above content.

The foregoing description is only the description of various embodiments of the present disclosure and the employed technical principles. A person skilled in the art should understand that the scope of the present disclosure in the present disclosure is not limited to a technical solution formed by a specific combination of the technical features. In addition, other technical solutions formed by any combination of the foregoing technical features or equivalent features thereof shall be encompassed without departing from the concept of the present disclosure. For example, the technical solutions formed by mutual replacement between the foregoing features and the technical features having similar functions (however, the technical features are not limited thereto) disclosed in the present disclosure shall be encompassed.

Furthermore, although a specific order is used to depict the operations, this should not be interpreted that these operations are required to be performed in the specific order shown or in sequential order of execution. Multitasking and parallel processing may be advantageous in particular environments. In addition, while several specific implementation details are included in the above discussion, these should not be construed as limiting the scope of the present disclosure. Some features described in the context of separate embodiments may also be implemented in combination in a single embodiment. Conversely, various features described in the context of a single embodiment may also be implemented in multiple embodiments individually or in any suitable subcombination.

According to specific embodiments of the present disclosure, in the first aspect, a breakpoint continuous mopping method for a mopping robot is provided, including:

in a hybrid mode, if detecting that a water tank for supplying water for mopping is short of water when traveling to a first position, marking the first position as a first breakpoint position, the hybrid mode at least including a mopping mode; and after detecting that the water tank is supplemented with water, carrying out supplementary mopping on an unmopped region including the first breakpoint position in the mopping mode.

In some embodiments, the hybrid mode further includes a sweeping mode; and correspondingly, after detecting that the water tank is short of water, the method further includes: sweeping an unswept region from the first breakpoint position in the sweeping mode.

In some embodiments, when detecting that the water tank is supplemented with the water, carrying out the supplementary mopping on the unmopped region including the first breakpoint position in the mopping mode includes: if a sweep of the unswept region is completed in the sweeping mode and after detecting that the water tank is supplemented with water, carrying out supplementary mopping on the unmopped region from the first breakpoint position in the mopping mode.

In some embodiments, when detecting that the water tank is supplemented with the water, carrying out supplementary mopping on the unmopped region including the first breakpoint position in the mopping mode includes: if sweeping to a second position in the sweeping mode and after detecting that the water tank is supplemented with the water at the second position, carrying out supplementary mopping on the unmopped region from the second position in the mopping mode.

In some embodiments, carrying out supplementary mopping on the unmopped region from the second position in the mopping mode includes: after carrying out supplementary mopping on an unmopped region which is not swept from the second position in the mopping mode, carrying out supplementary mopping on an unmopped region from the first breakpoint position to the second position.

In some embodiments, the method further includes: in the mopping mode, if detecting that the water tank is short of water when traveling to a third position, marking the third position as a second breakpoint position and returning to a pre-marked water supplementation position to supplement water; and after detecting that the water tank is supplemented with water, carrying out supplementary mopping on the unmopped region from the second breakpoint position in the mopping mode.

In some embodiments, the unswept region includes the unmopped region and a mopping forbidden region.

According to the specific embodiments of the present disclosure, in the second aspect, a breakpoint continuous mopping apparatus for a mopping robot is provided, including:

a water shortage unit used for: in a hybrid mode, if detecting that a water tank for supplying water for mopping is short of water when traveling to a first position, marking the first position as a first breakpoint position, the hybrid mode at least including a mopping mode; and a supplementary mopping unit used for: when detecting that the water tank is supplemented with water, carrying out supplementary mopping on an unmopped region including the first breakpoint position in the mopping mode.

In some embodiments, the hybrid mode further includes a sweeping mode; and correspondingly, the apparatus further includes: a sweeping unit, which is used for sweeping an unswept region from the first breakpoint position in the sweeping mode.

In some embodiments, the supplementary mopping unit is used for: if a sweep of the unswept region is completed in the sweeping mode and after detecting that the water tank is supplemented with water, carrying out supplementary mopping on the unmopped region from the first breakpoint position in the mopping mode.

In some embodiments, the supplementary mopping unit is used for: if sweeping to a second position in the sweeping mode and after detecting that the water tank is supplemented with the water at the second position, carrying out supplementary mopping on the unmopped region from the second position in the mopping mode.

In some embodiments, carrying out supplementary mopping on the unmopped region from the second position in the mopping mode includes: after carrying out supplementary mopping on an unmopped region which is not swept from the second position in the mopping mode, carrying out supplementary mopping on an unmopped region from the first breakpoint position to the second position.

In some embodiments, the supplementary mopping unit is further used for: in the mopping mode, if detecting that the water tank is short of water when traveling to a third position, marking the third position as a second breakpoint position and returning to a pre-marked water supplementation position to supplement water; and after detecting that the water tank is supplemented with the water, carrying out supplementary mopping on the unmopped region from the second breakpoint position in the mopping mode.

In some embodiments, the unswept region includes the unmopped region and a mopping forbidden region.

According to the specific embodiments of the present disclosure, in the third aspect, a computer-readable storage medium storing a computer program therein, wherein the computer program, when executed by a processor, causes the processor to implement the breakpoint continuous mopping method according to any one of the embodiments in the first aspect.

According to the specific embodiments of the present disclosure, in the fourth aspect, an electronic device is provided, including: one or more processors; and a storage apparatus used for storing one or more programs, wherein the one or more programs, when executed by the one or more processors, cause the one or more processors to implement the breakpoint continuous mopping method according to any one of the embodiments in the first aspect.

Compared to the prior art, the solutions of the embodiments of the present disclosure at least have the following beneficial effects.

In the breakpoint continuous mopping method and apparatus for the mopping robot, the medium, and the electronic device provided by the present disclosure, if the mopping robot working in the hybrid mode detects that the water tank for supplying water for mopping is short of water at the first breakpoint position, the mopping robot is switched to the mopping mode after the water tank is supplemented with water, and carries out supplementary mopping on the unmopped region including the first breakpoint position. Thus, it is ensured that the mopping robot can complete sweeping and mopping tasks.

Although the present subject matter has been described using language specific to structural features and/or method logical actions, it should be understood that the subject matter defined in the appended claims is not necessarily limited to the particular features or actions described above. Rather, the particular features and actions described above are merely exemplary forms of implementing the claims.

What is claimed is:

1. A breakpoint continuous mopping method for a mopping robot, comprising:

providing the mopping robot, wherein the mopping robot comprises a water level detection apparatus;

marking, in response to the water level detection apparatus detecting that a water tank for supplying water for mopping is short of water at a first position, the first position as a first breakpoint position in a hybrid mode, wherein the hybrid mode at least comprises a mopping mode and a sweeping mode, and wherein a working region of the mopping mode is an unmopped region, a working region of the sweeping mode is an unswept region, and the unswept region comprises the unmopped region and a mopping-forbidden region;

sweeping the unswept region from the first breakpoint position in the sweeping mode; and in response to the water level detection apparatus detecting that the water tank is supplemented with water, carrying out supplementary mopping on the unmopped region comprising the first breakpoint position in the mopping mode;

wherein, in response to the water level detection apparatus detecting that the water tank is supplemented with water, carrying out supplementary mopping on the unmopped region comprising the first breakpoint position in the mopping mode comprises:

in a case where sweep of the unswept region is completed in the sweeping mode, in response to detecting that the water tank is supplemented with water at a preset position, carrying out supplementary mopping on the unmopped region from the first breakpoint position in the mopping mode; and in a case where the sweep of the unswept region is not completed in the sweeping mode, in response to sweeping to a second position in the sweeping mode and detecting that the water tank is manually supplemented with water at the second position, carrying out supplementary mopping, from the second position, on a first unmopped region that is not swept in the mopping mode, and then carrying out supplementary mopping on a second unmopped region between the first breakpoint position and the second position; wherein the unmopped region comprises the first unmopped region and the second unmopped region.

2. The breakpoint continuous mopping method according to claim 1, further comprising:

in response to detecting that the water tank is short of water at a third position, marking the third position as a second breakpoint position and returning to a pre-marked water supplementation position to supplement water in the mopping mode; and in response to detecting that the water tank is supplemented with the water, carrying out supplementary mopping on the unmopped region from the second breakpoint position in the mopping mode.

3. An electronic device, comprising:

at least one hardware processor; and a storage apparatus used for storing program instructions that, when executed by the at least one hardware processor, direct the at least one hardware processor to:

mark, in response to a water level detection apparatus detecting that a water tank for supplying water for mopping is short of water at a first position, the first position as a first breakpoint position in a hybrid mode, wherein the hybrid mode at least comprises a mopping mode and a sweeping mode, and wherein a working region of the mopping mode is an unmopped region, a working region of the sweeping mode is an unswept region, and the unswept region comprises the unmopped region and a mopping-forbidden region;

sweep the unswept region from the first breakpoint position in the sweeping mode; and in response to the water level detection apparatus detecting that the water tank is supplemented with water, carry out supplementary mopping on the unmopped region comprising the first breakpoint position in the mopping mode;

wherein the at least one hardware processor is further configured to:

in a case where sweep of the unswept region is completed in the sweeping mode, in response to detecting that the water tank is supplemented with water at a preset position, carry out supplementary mopping on the unmopped region from the first breakpoint position in the mopping mode; and in a case where the sweep of the unswept region is not completed in the sweeping mode, in response to sweeping to a second position in the sweeping mode and detecting that the water tank is manually supplemented with water at the second position, carry out supplementary mopping, from the second position, on a first unmopped region that is not swept in the mopping mode, and then carry out supplementary mopping on a second unmopped region between the first breakpoint position and the second position; wherein the unmopped region comprises the first unmopped region and the second unmopped region.

4. The electronic device according to claim 3, wherein the at least one hardware processor is further configured to:

in response to detecting that the water tank is short of water at a third position, mark the third position as a second breakpoint position and return to a pre-marked water supplementation position to supplement water in the mopping mode; and in response to detecting that the water tank is supplemented with the water, carry out supplementary mopping on the unmopped region from the second breakpoint position in the mopping mode.

5. A non-transitory computer-readable storage medium storing computer program instructions thereon that when executed by at least one hardware processor, direct the at least one hardware processor to:

mark, in response to a water level detection apparatus detecting that a water tank for supplying water for mopping is short of water at a first position, the first position as a first breakpoint position in a hybrid mode, wherein the hybrid mode at least comprises a mopping mode and a sweeping mode, and wherein a working region of the mopping mode is an unmopped region, a working region of the sweeping mode is an unswept region, and the unswept region comprises the unmopped region and a mopping-forbidden region;

sweep the unswept region from the first breakpoint position in the sweeping mode; and in response to the water level detection apparatus detecting that the water tank is supplemented with water, carry out supplementary mopping on the unmopped region comprising the first breakpoint position in the mopping mode;

wherein the at least one hardware processor is further configured to:

in a case where sweep of the unswept region is completed in the sweeping mode, in response to detecting that the water tank is supplemented with water at a preset position, carry out supplementary mopping on the unmopped region from the first breakpoint position in the mopping mode; and in a case where the sweep of the unswept region is not completed in the sweeping mode, in response to sweeping to a second position in the sweeping mode and detecting that the water tank is manually supplemented with water at the second position, carry out supplementary mopping, from the second position, on a first unmopped region that is not swept in the mopping mode, and then carry out supplementary mopping on a second unmopped region between the first breakpoint position and the second position; wherein the unmopped region comprises the first unmopped region and the second unmopped region.

6. The non-transitory computer-readable storage medium according to claim 5, wherein the processor is further configured to:

in response to detecting that the water tank is short of water at a third position, mark the third position as a second breakpoint position and return to a pre-marked water supplementation position to supplement water in the mopping mode; and in response to detecting that the water tank is supplemented with the water, carry out supplementary mopping on the unmopped region from the second breakpoint position in the mopping mode.

* * * * *